United States Patent [19]

Pauls

[11] Patent Number: 4,769,395

[45] Date of Patent: Sep. 6, 1988

[54] POLYURETHANE ASSEMBLY FOAM AND APPARATUS FOR THE PERFORMANCE OF ITS PRODUCTION PROCESS

[75] Inventor: Mathias Pauls, Haltern, Fed. Rep. of Germany

[73] Assignee: Polypag AG, Fed. Rep. of Germany

[21] Appl. No.: 30,879

[22] Filed: Mar. 26, 1987

[30] Foreign Application Priority Data

Mar. 27, 1986 [DE] Fed. Rep. of Germany ..... 3610345

[51] Int. Cl.[4] ..... C08G 18/14

[52] U.S. Cl. ..... 521/99; 521/128; 521/131; 521/137

[58] Field of Search ..... 521/131, 99, 137, 128

[56] References Cited

U.S. PATENT DOCUMENTS 4,651,899 3/1987 Pauls et al. ..... 222/130

*Primary Examiner*—Maurice J. Welsh

*Attorney, Agent, or Firm*—Reese Taylor

[57] ABSTRACT

The invention proposes a polyurethane assembly foam which is produced by foaming a mixture in which, before the completed foaming, there are brought together a solution of the propellant of the foam, a prepolymer of polyurethane, a reaction resin and, if need be, parts of its reagent with components kept separate from the solution until the final foaming, namely the reagent or individual ones of its components as well as possibly hardening accelerators of the polyurethane. The apparatus includes an outer pressure tank for the reception of the solution and an inner pressure tank for the separation of the components of the solution and a ram, movable from outside for perforating the inner pressure tank and permitting mixing of the contents of the tanks prior to release of the solution.

7 Claims, 3 Drawing Sheets

POLYURETHANE ASSEMBLY FOAM AND APPARATUS FOR THE PERFORMANCE OF ITS PRODUCTION PROCESS

RELATED PATENT APPLICATIONS

This application claims priority under 35 U.S.C. 119 based on Federal Republic of Germany Application No. P36 10 345.4 filed Mar. 27, 1986.

BACKGROUND OF THE INVENTION

The invention relates to a product as well as to an apparatus for the exercise of a process by which the product of the invention is produced.

The product of the invention is a polyurethane assembly foam. Such assembly foams are primarily useful for technical insulating by foaming-out of cavities and are used, moreover, also, for example, in building in order to avoid condensed water nests.

The invention relates, therefore, to polyurethane assembly foams which are obtained and processed by the bringing out of their components from pressure containers, for example, aerosol cans in situ. Such foams are softer than the so-called polyurethane hard foams, but mostly harder than the so-called polyurethane soft foams which are used inter alia for cushion material.

SUMMARY OF THE INVENTION

The polyurethane assembly foams according to the invention use, as a leavening agent or propellant, liquid gas, for example, fluorohydrocarbon or hydrocarbon, and as a reagent water, preferably solely the moisture of the air, possibly, however, also hydroxide compounds with hydroxyl groups which accelerate the hardening of the foam. The assembly foams of the invention harden, therefore, relatively rapidly to form after their processing a first sticky, but then hardened, material.

The reaction mixture required for the production of the polyurethane assembly foam of the invention may consist either of a prepolymer that contains free isocyanate groups or of a polyol component according to the so-called prepolymer process. The invention can be realized, however, also with a homogeneous reaction mixture that contains essentially the polyol, an isocyanate and the propellant, it being possible to use a catalyst and an emulsifier as well as further aids, for example, the hydroxide compounds mentioned, in order to accelerate the hardening and to improve the quality of the foam.

The apparatus, according to the invention, proceeds correspondingly from a pressure container of known type (German unexamined patent specification DE-OS No. 33 22 811). The pressure container consists essentially of a pressure can and an additional container which is accommodated in the pressure can. It contains a reagent which accelerates the foam hardening. Because of its composition and its action on the prepolymer contained in the pressure can, it is kept separate from this until the foam is to be brought out. Then with a movable ram sealed in the bottom of the pressure can, the cover of the additional container is burst into the can and the content of the additional container shaken into the can. The resulting mixture is immediately brought out.

The materials formed from such prior-known polyurethane assembly foams have physical and chemical properties which are known and cannot any longer be substantially further developed or improved. This means that certain properties are lacking which, for various reasons, are desired in assembly foams of this type. Among these are, for example, a higher strength, an improved climate stability, an improved chemical resistance and many others.

It has proved, surprisingly, that many of these desired properties are achievable with a product, according to the invention, which shows, moreover, novel properties.

Thus, the foam can be produced by foaming of a mixture in which are brought together before the foaming a solution of the propellant of the polyurethane, a prepolymer of the polyurethane, a reaction resin and, if need be, parts of a reagent with components kept separate until the final foaming of the solution, namely the reagent or individual ones of its components of the reaction agent as well as possibly hardening accelerators of the polyurethane.

With the product of the invention, namely, there arises in the polyurethane assembly foam of the reaction resin and its reagent, which on its part can consist of a hardener and an accelerator, a material in which the hardened reaction resin is distributed in a fine structure. This assembly foam has, on the one hand, the properties of the polyurethane and, on the other, of the reaction resin. It is, therefore, inter alia harder, shows an improved fire behavior and absorbs less water. Moreover, however, there occurs a synergism. In particular, the assembly foam can be handled better and gives a greater yield. These properties of the product of the invention can be explained, at any rate, in part from its skeleton structure which is formed in the polyurethane foam from the hardened reaction resin. The skeleton structure can be determined in respect to its constituent in the total mass of the assembly foam and its distribution in this within certain limits by the addition and distribution of the reaction resin and by the amount and type of the reagent.

In the polyurethane assembly foam of the invention, there can be virtually all hardenable, technical resins. Above all, however, cross-linkable unsaturated polyester resins and epoxide resins show favorable properties. Here, the components are incompatible with one another, i.e., the constituent of the reagent of the resin consisting of peroxide and possibly a hardening accelerator of the polyurethane foam are separated from one another until the foam is to be brought out. In this manner, the foam is prevented from spoiling because of undesired reactions in the pressure container.

With the features of the present invention, the hardenable, technical resins used for the product of the invention are extended also to substances that are either incompatible with the substances of the solution or for other resasons should be added to the reaction mixture only shortly before the bringing-out of the foam. The latter is the case, inter alia, when the hardening accelerator is to be admixed, for example, from a special pressure container with higher or lower pressure than the comparative pressure under which the solution stands.

Accordingly, production of a polyurethane assembly foam and apparatus for the performance of its production process of the character just described becomes the principal object of this invention with other objects thereof becoming more apparent upon a reading of the following brief description and consideration of the accompanying drawings.

OF THE DRAWINGS

BRIEF DESCRIPTION OF THE PREFERRED EMBODIMENT

Figure 1:
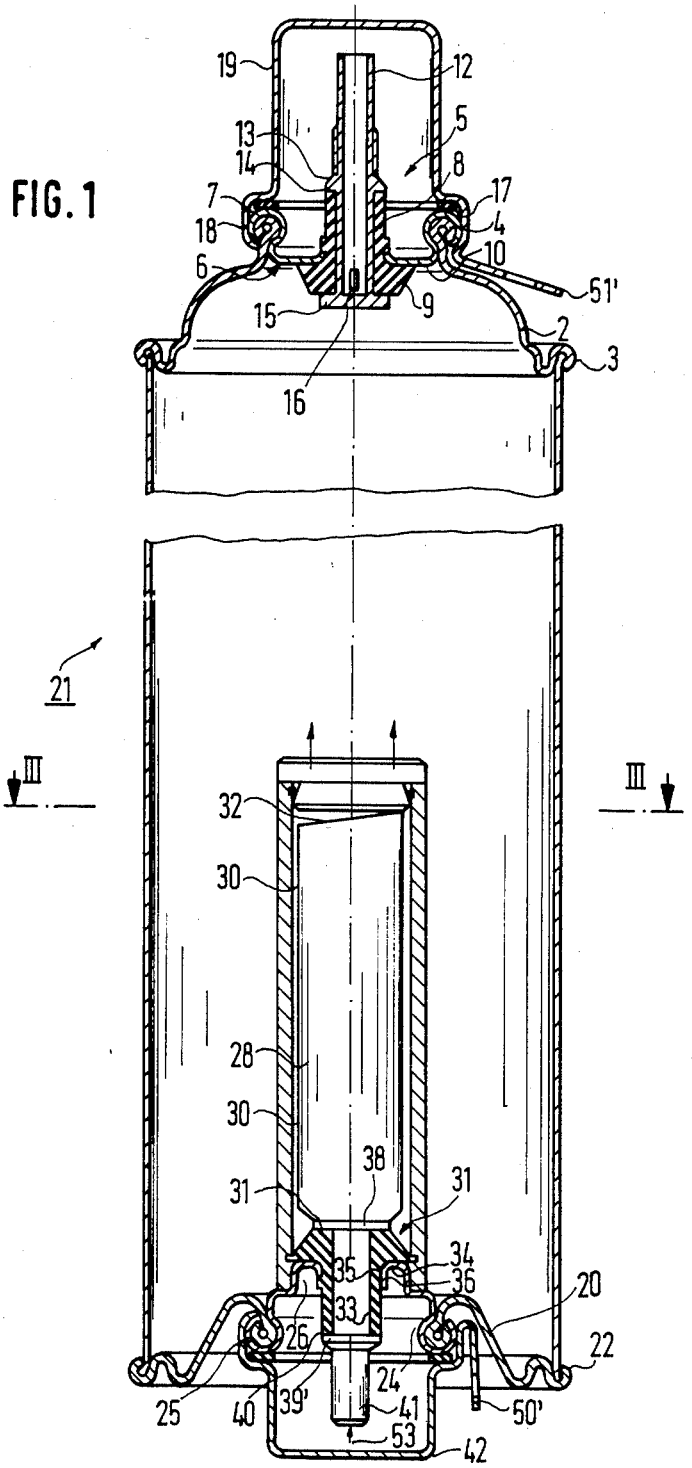
FIG. 1 shows, in longitudinal section, a pressure can for the explanation of the apparatus of the invention.

The pressure container depicted in the figures consists of a rim 1 in the form of a cylindrical tube which is closed at on end with a dome 2. The dome has a flanged edge 3 which holds fast the end concerned of the rim 1 and simultaneously brings about a tight connection of the parts. The pressure container dome is produced from a rondel, i.e., a round plate, a shaped part cut out of sheet metal which, through reshaping, has obtained the domed form to be seen from the drawing. The inner edge of the rondel is flanged, as represented at 4, and receives a plate valve 5. The valve plate 6 is on its part flanged with an edge 7 about the wheel 4 of the rondel and thereby sealed against this. It holds a rubber stopper 8 which on its part abuts with a flange-form widening 9 on the underside 10 of the valve plate 6 and is pierced by a hollow valve rod 12. This rod has an outer collar 13 which abuts on the outer edge 14 of the plug. The tubular section of the valve is closed off by a plate 15. Under the plate 15 and in the tube there lie, however, one or several openings 16 of the tube shell. A disk seal 17 is tensioned by the edge 18 gripping around the flange 4 of a cover 19 and provides that no atmospheric moisture can force its way in from outside.

At the opposite end, there is present the bottom 20 of the pressure can designated generally with 21. It corresponds to a concavely inward-folded dome 2, there being present in its stabilizing folds enough material in the case of excessive pressure development, for example, at temperatures above 50° C., to cuff outward and thus to provide for volume increase in the total container and additional safety space. Except for the curvature inward, however, the bottom corresponds in all parts to the cover 2, so that it is possible to dispense with its description in detail. It is held fast on the end concerned of the rim 1 with a flanged edge 22. It is on its own made of a rondel of which the edge surrounding the recess provided in the middle is flanged over as represented at 23. On this edge, there is fastened by a flanging 25, a plate 24. The plate has an annular depression 26.

A sleeve 31 of a sealing material presents an inner collar 32 which is seated on a shoulder 34 of an annular depression 26 of the plate. The connecting, cylindrical section 33 of the sleeve 31 is held by the inner edge 35 of the depression 26. The sleeve is axially blocked inward. For this, there serves the closed linkage that is established at 36 between the inner edge of the depression 26 and an inner section enlarged in diameter of the sleeve 31.

Concentrically in the sleeve 31, there is seated a rod constructed as ram 37. It presents an inner collar 38 with which it is supported on the inner edge 39 of the sleeve 31. Furthermore, it has an outer collar 39$^1$ which can abut correspondingly on the outer edge 40 of the sleeve 31. The outward-projecting ram end 41 is covered with a cap 42 in the manner of the cap 19.

The ram 37 forms a component with a plate 28 which has parallel longitudinal edges 29,30 and a beveled transverse edge 32$^1$ sloped with respect to the ram-side transverse edge 31$^1$.

Figure 2:
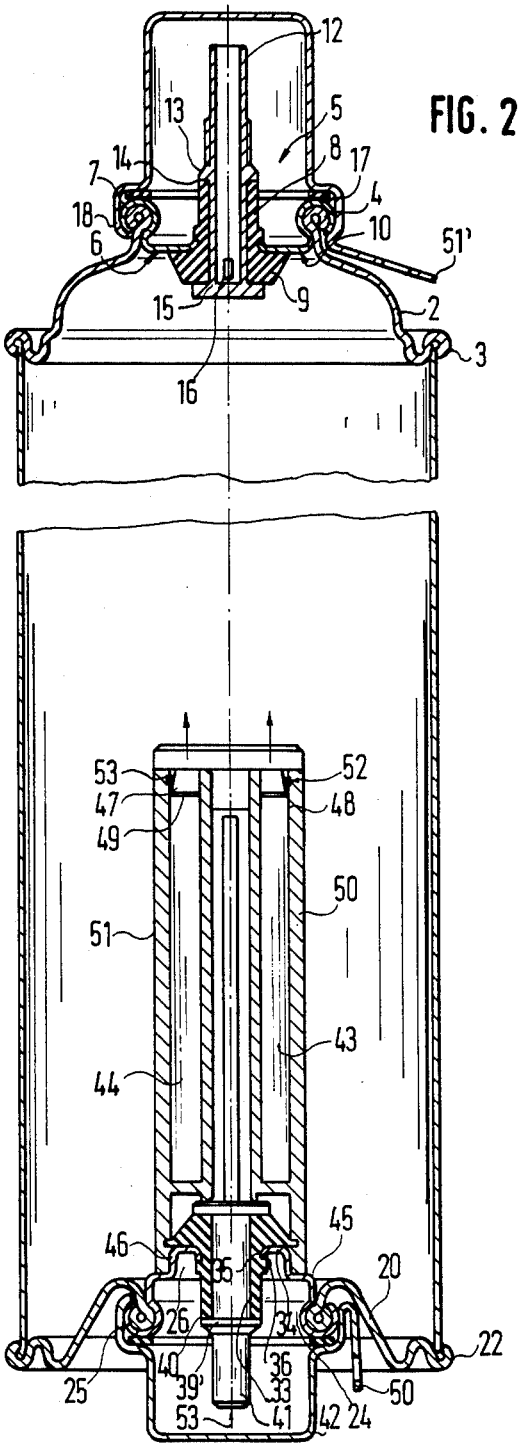
FIG. 2 shows the object of FIG. 1 in a position turned through a quarter of a circle.

Referring to FIG. 2, the pressure container 21 contains inner containers 43,44 which, with projecting edges 5,6 are fixed in the flanging 22 of the outer pressure container 21. The two pressure containers 43,44 have a bottom cover 47 in common which is installed with projections 48,49, corresponding to the form of the two pressure containers 43,44 into the rims 50,51 of the pressure containers 43,44. O-ring seals 52,53 seal off the bottom 47 with the rim ends which are fixed in closed linkage in the bottom 47.

Figure 3:
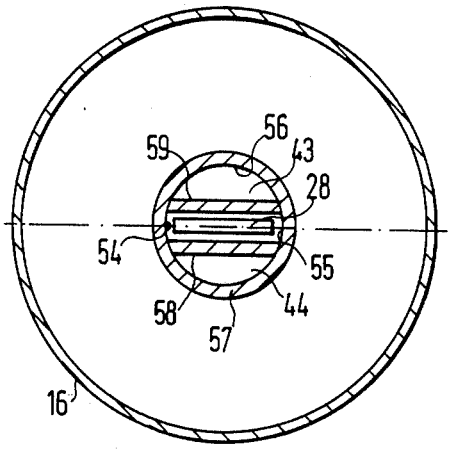
FIG. 3 shows a section along the line of 3—3 of FIG. 1.

As is yielded from the representation of FIG. 3, the contour of each pressure container 43,44 follows the arc allocated to it of the rim tube 1 of the outer pressure container 21 up to installed arcuate guides 54,55 for the longitudinal edges of the plate 28. Following upon the arcuate sections which are designated in FIG. 3 with 56 and 57, there extend flat sections 58,59 with which the rim form is completed. Between the flat sections 58 and 59 there lies the plate 28.

The two inner containers 43,44 serve for the separate accommodation, on the one hand, of a reaction mixture which contains besides the components of a polyurethane assembly foam a reaction resinand of a reagent which presents a hardener and an accelerator which in the example of execution represented are chemically incompatible with the reaction mixture of the polyurethane assembly foam or the reaction resin.

In situ, the user first removes the cap 42. This is relatively simple because for this he merely has to pull on the tongue 50$^1$ which forms a component with the cap 42, whereby its edge is deformed and drawn off from the flanging 23. After the tongue 51$^1$ of the cap 19 has been actuated in a corresponding manner, the user strikes the pressure container 21 with the end 41 of the ram 37 on a solid underlayer. Thereby an axial movement of the ram 37 is triggered which, in consequence of the support of the outer collar 39$^1$ on the outer edge 40 of the sleeve 31, leads to its resilient yielding. Thereby the plate 28, forming a component with the ram, is struck with its beveled edge 32$^1$ on the bottom 47. This leads to the bursting of the bottom 47 from the rims of the two inner pressure containers 43 and 44. The content of these two containers 43,44, freed thereby into the interior of the pressure container 21, is mixed by shaking. Then by tilting of the valve 12, the container contents can be brought out. In the process, the plate 15 is lifted from the collar 9, whereby the opening 16 becomes free and the container contents flow off throughout the valve tube out of the pressure container. The valve tube can receive a connecting hose that leads to a spray gun. These parts are not represented. From the spray gun, there is brought out the assembly foam.

What is claimed is:

1. A polyurethane assembly foam formed by mixture of a solution, comprising:

(a) a propellant;

(b) a polyurethane prepolymer;

(c) a reaction resin to be distributed in a fine structure within the polyurethane assembly foam thereby enabling formation of a skeleton structure therein; and (d) a reagent of said reaction resin wherein said reagent, or parts thereof, is reactable to form said resin with the proviso that said reagent, or parts thereof, are kept separate from the other solution components until final foaming of the solution.

2. A polyurethane foam, as set forth in claim 1, wherein said solution further comprises a hardener.

3. A polyurethane foam, as set forth in claim 2, wherein said solution further comprises a hardening accelerator of the polyurethane selected from the group consisting of hydroxide compounds having hydroxyl groups.

4. A polyurethane foam, as set forth in claim 1, wherein said reagent comprises a peroxide.

5. A polyurethane foam, as set forth in claim 3, wherein said resin comprises polyester, said reagent comprises a peroxide and at least one of amine hardeners or cobalt salt, and said solution comprises one of said hardening accelerators of the polyurethane.

6. A polyurethane foam, as set forth in claim 5, wherein said peroxide and said accelerator are kept separate from each other.

7. A polyurethane foam, as set forth in claim 6, wherein said peroxide and said accelerator, which are kept separate from each other, are further kept separate from other said solution components.

* * * * *